United States Patent [19]

Adams et al.

[11] 4,270,616

[45] Jun. 2, 1981

[54] BULLDOZER BLADE MOUNTING ASSEMBLY

[75] Inventors: Carl P. Adams, Metamora; Royce D. Allen, East Peoria; Frederick L. Kokaly, Plainfield, all of Ill.

[73] Assignee: Caterpillar Tractor Co., Peoria, Ill.

[21] Appl. No.: 949,589

[22] Filed: Oct. 10, 1978

[51] Int. Cl.[3] ..... E02F 3/76

[52] U.S. Cl. ..... 172/811; 180/69.1

[58] Field of Search ..... 172/801-809; 414/685, 686, 719, 722, 727; 180/69.1

[56] References Cited

U.S. PATENT DOCUMENTS

| | | | |
|---|---|---|---|
| 2,690,848 | 10/1954 | Beyerstedt | 414/685 |
| 3,043,375 | 7/1962 | Astrom | 414/685 X |
| 3,279,105 | 10/1966 | Kolinger | 172/801 |
| 3,335,882 | 8/1967 | Engesser | 414/685 |
| 3,487,884 | 1/1970 | Volberding | 172/801 |
| 3,521,713 | 7/1970 | Spanjer | 172/809 |
| 3,543,867 | 12/1970 | Durango | 172/801 |
| 3,780,813 | 12/1973 | Davis | 172/801 |
| 3,809,167 | 5/1974 | Glider | 172/801 |
| 4,031,968 | 6/1977 | Krolak | 172/801 |
| 4,151,887 | 5/1979 | Freese | 414/722 |

*Primary Examiner*—Richard J. Johnson

*Attorney, Agent, or Firm*—Wegner, Stellman, McCord, Wiles & Wood

[57] ABSTRACT

A mounting assembly (22) for an inside arm C-frame (18) of a bulldozer blade (26) is provided and includes a pair of brackets (30,30, 130,130) joined together by a tractor belly guard (32). Each bracket (30,30, 130,130) is pinned to the tractor frame (12) by a main pin (50) in the upper portion thereof and has a trunnion (52,152) at the lower portion thereof for connection to the arms (20,20) of the C-frame. The forward portions (60,162) of the brackets (30,130) are pinned (74) to the tractor frame (12) in a way as to constrain only that force known as torque or moment of rotational force, generated about said main pin (50). The belly guard (32) can be pivoted down out of the way for servicing the tractor.

9 Claims, 8 Drawing Figures

FIG. 5
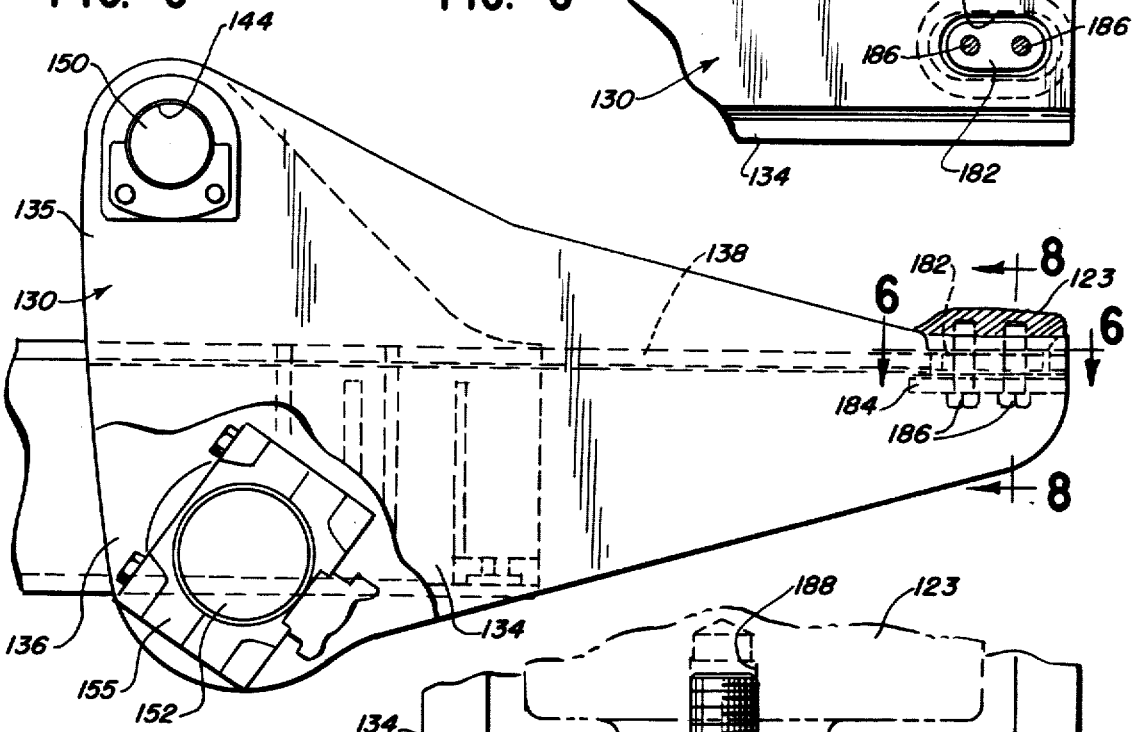
FIG. 6
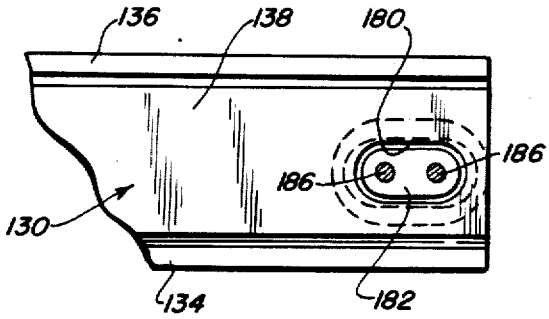
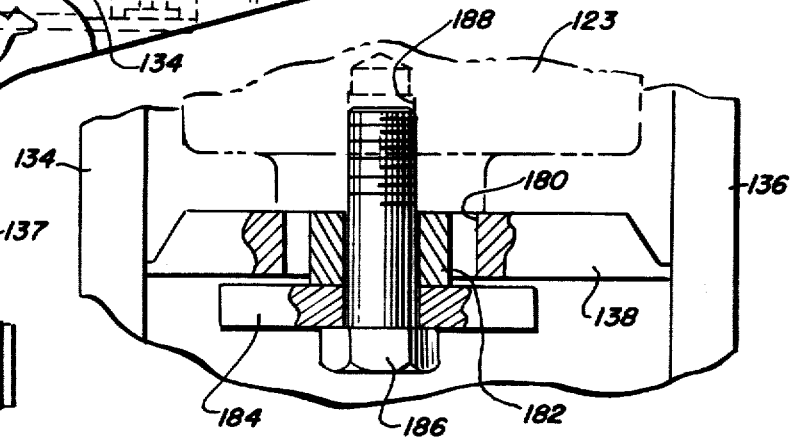
FIG. 8
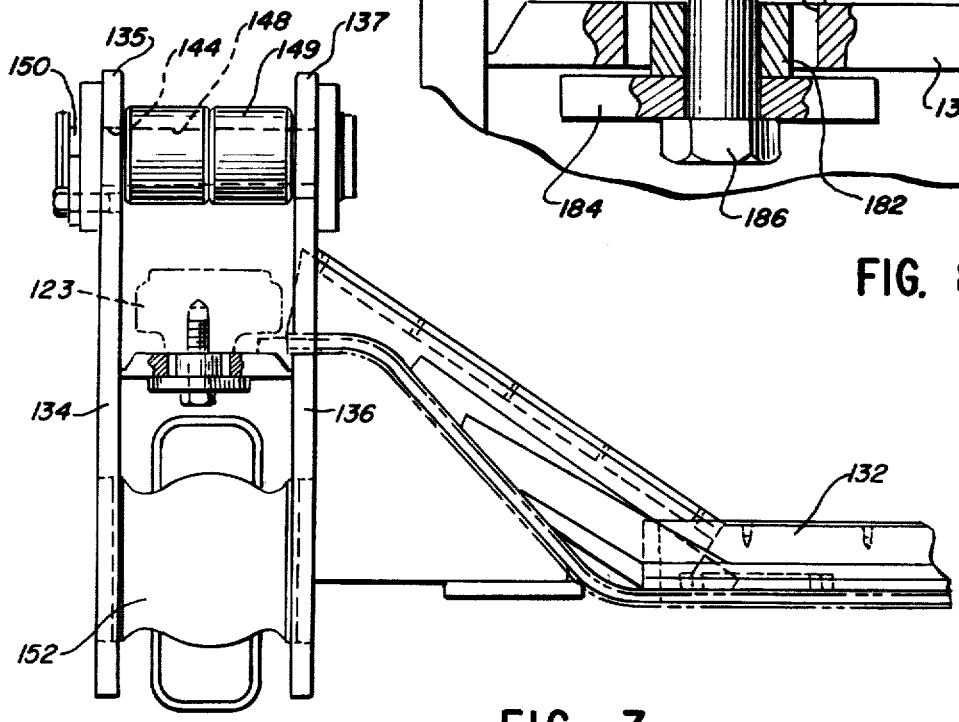
FIG. 7

BULLDOZER BLADE MOUNTING ASSEMBLY

TECHNICAL FIELD

This invention relates to a bulldozer blade and, more particularly, to an improved mounting assembly for an inside arm C-frame of said blade.

BACKGROUND ART

Tractors having bulldozer blades and, in particular, cushioned push blades, have been subjected to the problem that the loads on the blade may possibly lift the front of the tractor which may reduce the effectiveness of the push being administered by the tractor. Also, the mounting of some blades to the tractor frame have been such as to weaken the tractor frame.

In U.S. Pat. No. 3,279,105 in the name of K. J. Kolinger et al, issued Oct. 18, 1966, a bulldozer blade has a pair of arms pivoted to the tractor frame near the lower front corner of said tractor frame. In addition, spring-cushioning arrangements are provided for the upper corners of the blade which are connected to the tractor frame near the upper corners thereof. This arrangement may provide force for pushing upwardly against the front of the frame of the tractor which could lift the front of the frame of the tractor relative to the tracks reducing the effectiveness of the push.

U.S. Pat. No. 3,487,884 in the name of H. Volberding, issued Jan. 6, 1970, provides a bulldozer blade wherein arms extend from the bottom corners of the blade to a bracket hanging down from the midportion of the frame of the tractor. The brackets are welded, bolted, or otherwise secured to the tractor frame. The upper portions of the blade are connected to the forward corners of the tractor frame. The connections of the brackets supporting the arms on the frame may weaken the frame that could result in failure of the support for the blade assembly.

U.S. Pat. No. 3,521,713 in the name of D. J. Spanjer et al, issued July 28, 1970, shows a blade mounted to a pivoted bracket projecting downward from the frame of the vehicle with the upper portion of the bracket being movable by hydraulics. Here the forces on the blade may lift the front of the tractor during a push. In addition, the attachment of the bracket to the vehicle may weaken the vehicle frame.

U.S. Pat. No. 3,809,167 in the name of Lawrence James Glider, issued May 7, 1974, shows a blade pivoted directly to the frame of the vehicle on the forward portion of the frame, such that pressure on the blade may lift the front of the vehicle which may reduce the effectiveness of the push.

All of these patents suffer the disadvantages that they either may cause the front of the tractor to be lifted under the loading applied to the blade, or due to the way they are attached to the tractor frame, they may weaken the tractor frame causing premature failure.

DISCLOSURE OF INVENTION

In one aspect of the present invention a mounting assembly is provided for mounting a bulldozer blade to a tractor frame using a C-frame connected to said bulldozer blade and to a pair of interconnected mounting brackets. Each bracket is pinned to said tractor frame and has a trunnion carried by a lower portion of said bracket. A member is provided for supporting a forward portion of each bracket on said tractor frame to permit fore and aft movement of said bracket relative to said tractor frame.

The problems to which the present invention are directed are first, the problem of the front of the tractor being forced upward in the air as a result of the loading on the bulldozer blade or push blade which effectively reduces the applied force expended by the tractor through the bulldozer blade. The second problem has to do with the weakening of the tractor frame by a plurality of holes for attaching a bracket or by welding a bracket onto the frame for securing the ends of the C-frame to the tractor frame. These problems have been overcome by using a pair of brackets, which are interconnected, with each bracket straddling the side frame portion of the tractor frame with pivot pins passing through the arms of the bracket and the tractor frame. The forward part of each bracket is secured to the forward part of the tractor frame by a connection that holds the bracket to the frame but permits the bracket to shift fore and aft with respect to the connection and with respect to the tractor frame. Each arm of the C-frame of the bulldozer blade is pivotally connected to a trunnion carried by one of the brackets so that forces created by pushing heavy loads with the bulldozer blade will not lift the front of the tractor, nor will the tractor frame be weakened by the use of several bolts or by welding, both of which applied shear and other loads directly to the tractor frame. None of the prior art provides such a bracket with such a loading arrangement.

BRIEF DESCRIPTION OF THE DRAWINGS

FIG. 5 is an enlarged broken away view of a modification of the bracket assembly of FIG. 1;

FIG. 6 is a cross-sectional view taken along the line 6—6 of FIG. 5;

FIG. 7 is a partial front view of the bracket of FIG. 5 showing part of the belly guard attached thereto; and, FIG. 8 is an enlarged partial cross-sectional view taken along the line 8—8 of FIG. 5.

BEST MODE FOR CARRYING OUT THE INVENTION

Figure 1:
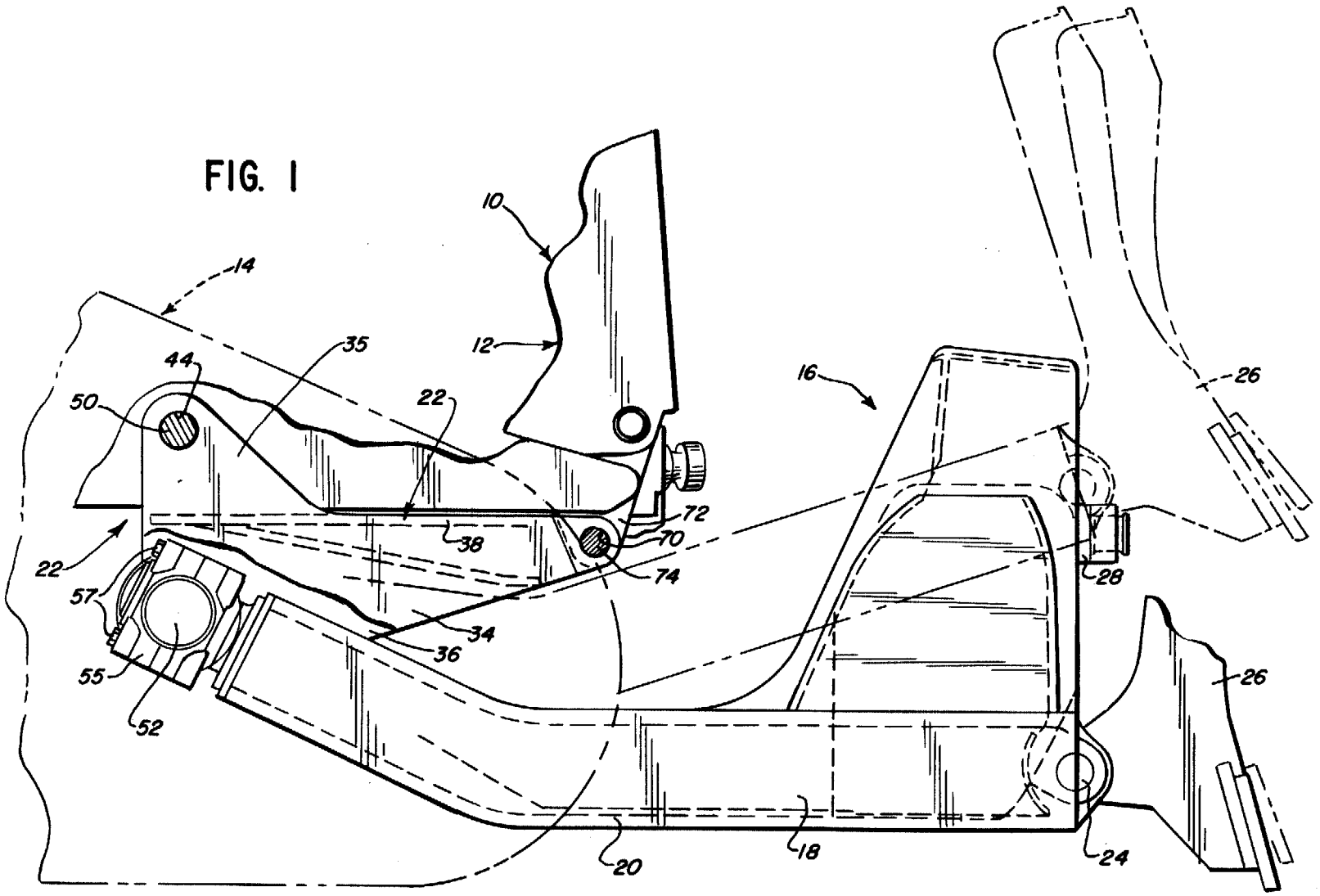
FIG. 1 is a broken away elevational view of the front portion of the tractor frame and the mounting assembly for mounting a bulldozer blade to said tractor frame.
Figure 4:
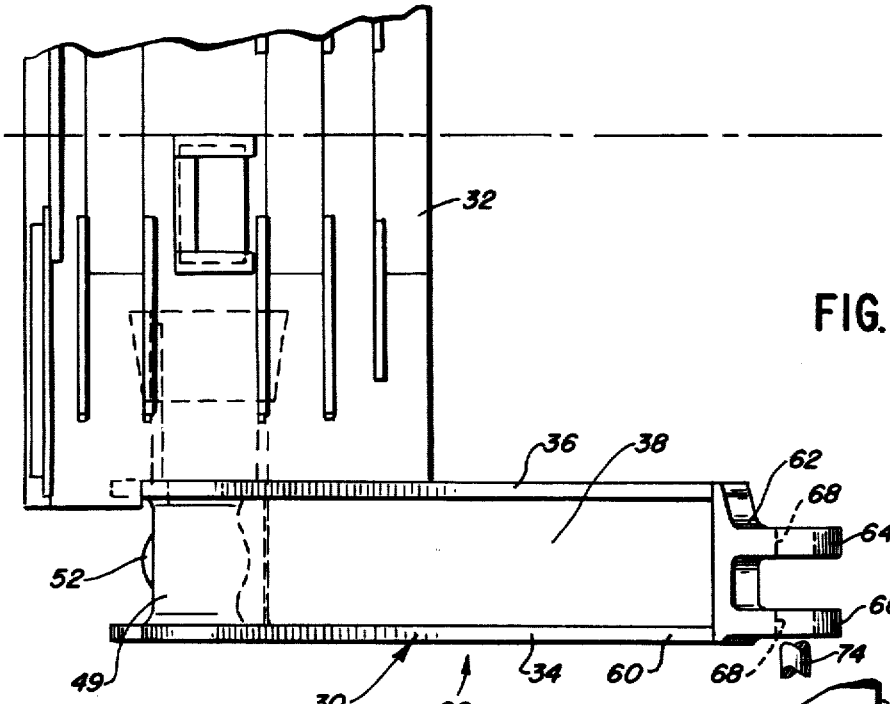
FIG. 4 is a top view of a bracket and part of the belly guard of FIG. 2.

Referring to the drawings wherein like reference numerals refer to like parts throughout, a tractor 10 has only the front lower corner of the frame 12 shown and has a pair of tracks 14 with one shown in phantom in its relative position with respect thereto. A cushioned push blade assembly 16 is comprised of a C-frame 18 having spaced arms 20,20 pivotally connected to a mounting assembly 22 which mounting assembly is connected to the frame 12 of the tractor 10. The front end portion of the C-frame 18 is pivotally connected at 24 to the lower corners of the push blade 26. The upper portions of the push blade 26 are pivotally and resiliently connected to the push blade assembly 16 which connection includes resilient cushioning means 28 and the like. The construction and assembly of the push blade assembly 16 including the C-frame 18, the push blade 26, and the cushioning means 28, together with the connection of the push blade 26 to the C-frame 18, is conventional and can be any one of the many different arrangements available on the market. In FIG. 1, the push blade 26 is shown in solid lines in the down position and is shown in phantom or dotted lines in the raised position. A hydraulic actuator or similar apparatus is provided between the upper portion of the tractor frame 12 and the push blade assembly 16 so as to raise and lower the front of the C-frame 18 and the push blade 26 as desired.

An embodiment of the present invention is best illustrated in FIGS. 1–4 wherein the mounting assembly 22 is shown comprised of a pair of brackets 30 which are held in spaced apart relationship by a belly guard assembly 32. In FIG. 1, one side of one bracket 30 is broken away to reveal the connection of the C-frame 18 to the bracket. Each bracket 30 is comprised of a pair of spaced apart somewhat triangularly-shaped side plates 34 and 36 which are held apart in rigid relationship by a plurality of plates 38, 40 and 42 with portions 35,37 of the spaced sidewalls or plates 34 and 36 extending upwardly from said support plate 38 and having aligned openings 44,46, respectively, therethrough. The upwardly extending portions 35,37 with the openings 44 and 46 are adapted to straddle the side rail 23 of the tractor 10 so that the openings 44 and 46 will align with an aperture 48 through bushings 49 in said side frame of the tractor so that a pin 50 can pass therethrough to pin the plates 34,36 of each bracket 30 to the tractor frame 12.

Directly below the openings 44 and 46 and in the lower portion of each bracket 30 is a trunnion 52 which is fastened in apertures 54 in the side plates 34 and 36. The trunnions 52 are located below the frame 12 of the tractor 10 when the support plate 38 of the bracket engages against the bottom face of the tractor frame. Each arm 20,20 of the C-frame 18 is pivotally attached to a trunnion 52 of a bracket 30 by a cap 55 and bolts 57 wherein said bolts secure the cap over the trunnion 52 and against the end of the arms 20,20 so that the C-frame 18 is pivoted relative to the bracket 30 and is supported by the brackets. The side plates 34, 36 of each bracket 30 project forwardly of the portions 35,37 and trunnions 52 to provide a forward portion 60 which has a bifurcated end portion 62 attached to the outer end portion thereof. The bifurcated portion 62 has a pair of spaced apart arms 64,66 projecting outwardly in a pair of planes lying parallel to the longitudinal axis of the bracket 30. The arms 64 and 66 have aligned apertures 68 therethrough. The arms 64,66 are adapted to straddle an ear 72 depending from the foward portion of the tractor frame. The ear 72 has an aperture 70 which is aligned with the apertures 68 in the arms 64,66. A pin 74 is passed through the apertures 68 and 70 and is held therein by locking caps 75.

The diameter of each aperture 68 is greater than the diameter of the pin 74 while the diameter of the aperture 70 is substantially the same as the diameter of said pin 74, such that the pin 74, when in position in said apertures 68, 70,68, serves to hold the forward portion 60 of the bracket loosely to the tractor frame 12 but at the same time permits fore and aft movement between the pin 74 and the bracket 30. In the just described situation, pin 50 resists all the fore and aft shear loads while pin 74 feels only the vertical force resulting from summing moments about pin 50. Since trunnion 52 is closer to pin 50 than to pin 74, the resulting vertical force in pin 74 is greatly reduced.

Extending between the spaced apart brackets [illegible] belly guard 32 which is comprised of a plurality of appropriately shaped plates and [illegible] which belly guard 32 is attached as in brackets 30 to hold the brackets 30 in substantially rigid spaced apart relationship and acts to stabilize one bracket 30 with respect to the other.

In a modified embodiment, such as shown in FIGS. 5–8, the side plates 134,136 of each bracket 130 are substantially the same and are connected to the belly guard 132 in substantially the same manner as the embodiment of FIGS. 1–4. A pin 150 passes through apertures 144 in portions 135, 137 and in aperture [illegible] in the bushings 149 in the tractor frame to pin the bracket to the frame. Each bracket has a trunnion 152 attached thereto by means of a cap 155 and bolts 157. The forward portion 162 of the bracket 130 is attached to the tractor frame in a different manner. That is, the side walls 134 and 136 of the bracket are held spaced apart by spacer plates with one such plate 138 having near the outer end portion thereof, an oblong or elongate opening 180 formed therethrough. With the plate 139 engaging the bottom of the side rails 123 of the tractor frame, an elongate, oblong spacer 182, which is of the same general shape but of smaller size than the opening 180 in the plate 138, is positioned in the opening 180 and is held therein by an enlarged oblong washer or retainer 184 and a pair of bolts 186 which are threaded into openings 188 in the rail 123 of the frame.

The elongate spacer 182 has an axial length which is greater than the thickness of the top plate 138 so as to hold the washer or retainer 184 spaced from the plate 138 of the bracket. The washer or retainer 184 is larger than the opening 180 in the top plate 138 so that it overlaps with the opening 180 at least partially around the outer periphery thereof to retain the forward portion 162 of the bracket in position on the tractor frame. The spacer 182 is of a size as to provide a clearance all the way around the outer periphery thereof such that the bracket can move fore and aft without placing any load on the bolts 186 and on the tractor frame around the bolts 186. As shown in FIG. 8, the spacer 182 is of a thickness as to position the retainer 184 such that the forward portion 162 of the bracket can move toward and away from the tractor frame a limited amount so as to place only minor loading on the tractor frame around the bolt openings 188. Since the trunnion 152 is closer to pin 150 than to bolts 186, the resulting vertical force in bolts 186 is greatly reduced. In FIG. 8, the clearance between opening 180 and spacer 182 and between retainer 184 and rail 123 of the tractor frame is shown in exaggerated size. The spacing of the walls of the enlarged opening 180 relative to the spacer 182 is such as to exceed any tolerances built into the connection between the pin 150, the bracket 130 and the tractor frame so that at no time will the spacer 182 act as a shear member between the bracket and the frame.

Figure 2:
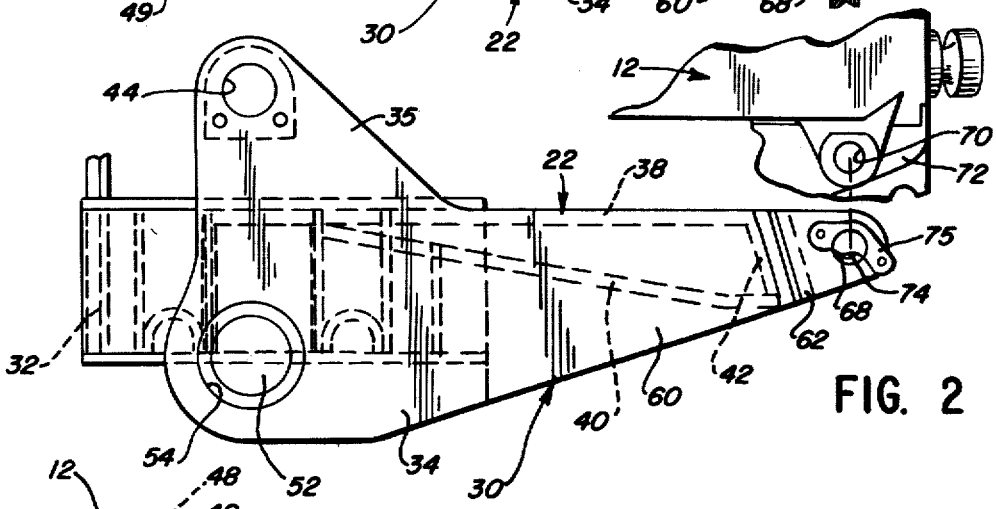
FIG. 2 is a somewhat exploded view of the connection between the front portion of the bracket and the tractor frame of FIG. 1.
Figure 3:
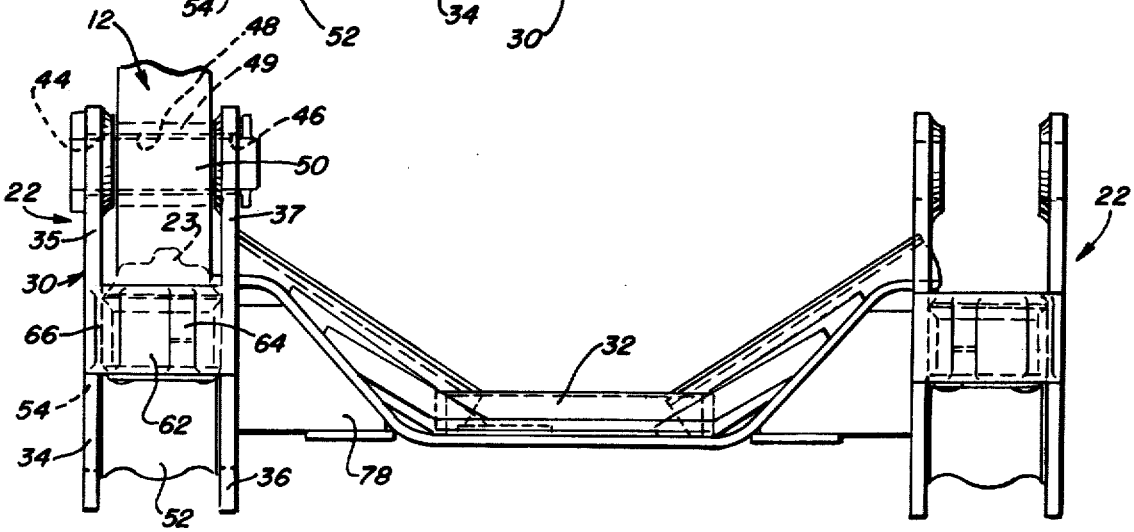
FIG. 3 is a front elevational view of the two brackets interconnected by a belly guard structure.

In both embodiments, the belly guard 32,132 extends between the spaced apart brackets 30,130, which belly guard is free to pivot out of covering relationship with respect to the engine or driveline either about the pins 74,74 of FIG. 2 or about the attaching pins 50,50, 150,150 securing the bracket to the tractor frame.

INDUSTRIAL APPLICABILITY

With the brackets 30 of the embodiment of FIGS. 1–4 attached to the tractor frame 12, [illegible] side arms 20,20 of the C-frame 18 are connected to the trunnions 52 [illegible]

means of caps 55 which are bolted over the trunnions 52 whereupon the C-frame 18 is pivotally and detachably mounted about the axis of the trunnion 52 as it is raised and lowered during use. All of the forces transmitted from the tractor 10 to the push blade 26 will go through the brackets 30 and through the push arms 20,20 and since the connections between the C-frame 18 and the brackets 30 are rearward of the front corner of the tractor frame 12, the forces will be applied directly into the tractor frame and will not have a tendency to lift the front of the tractor frame. Since the pins 74 connected to the forward portions 60 of the brackets 30 are spaced from the walls of the apertures 68 through the ends of the brackets, there will be no horizontal shear loads applied between the pins 74 and the frame. Since the brackets 30 are pinned to the frame 12 by pins 50 and since the brackets bear against the lower surface of the frame, forces applied to the trunnions 52 will come from the pins 50 and possibly between the frame 12 and the rear portion of plate 38, but no horizontal force will come from the forward portions 60 of the brackets 30 and pins 74. In this way, a reduced vertical or longitudinal loads and no horizontal load will be applied by the bracket to the front corner of the tractor frame. The bracket is connected to the tractor frame by a pair of substantially aligned pins 50 which will not materially weaken the frame as was the case heretofore with bolting and/or welding the bracket to the lower portion of the frame. If it is desired to service the engine from below, the C-frame 18 is disconnected from the brackets 30 and the rear pins 50 are pulled from the upper portion of the brackets 30 so that the brackets and the belly guard 32 are pivoted about the axis of the forward pin 74 so as to provide access to the undercarriage.

The embodiment shown in FIGS. 5–8 provides for bolting the forward end of the bracket to the tractor frame but in such a way that no shear loads are created on the fasteners or on the tractor frame. In this way, smaller fasteners can be used which will not have any material affect on the structural strength of the tractor frame. The brackets 130 are connected to the tractor frame by a pair of aligned pins 150,150 with the crossplate 138 of each bracket 130 bearing against the undersurface of the tractor frame. The pins 150 for mounting the brackets 130 to the frame do not weaken the tractor frame and are located rearward to a point that the front of the tractor is not lifted under extreme pushing forces.

Other aspects, objects and advantages of this invention can be obtained from a study of the drawings, the disclosure and the appended claims.

What is claimed is:

1. A mounting assembly for mounting a bulldozer blade (26) to a tractor frame (12), a C-frame (18) connected to said bulldozer blade and having arms (20,20) extending rearward therefrom, a pair of mounting brackets (30,30, 130,130), means (32,132) below said tractor frame (12) for interconnecting said brackets (30,30, 130,130), an upper portion (35,37, 135,137) of each bracket (30,130) being pinned (50,150) to said tractor frame, a sidewardly extending trunnion (52,152) mounted on a lower portion of each bracket, means (55,155) for pivotally connecting the arms (20,20) of said C-frame (18) to said trunnions (52,152), and means (74,186) lying in a plane transverse to a longitudinal axis of the tractor frame for supporting a remote portion (60,162) of each bracket on said tractor frame to permit fore and aft movement of said bracket relative to said tractor frame without applying shear forces therebetween.

2. A mounting assembly as claimed in claim 1 wherein said last-named means includes at least one bolt passing through a retainer (184) and spacer (182) both of which are spaced from said forward end portion (60,162) of each bracket to substantially eliminate fore and aft loading of said bolt thereby reducing the stresses on said tractor frame.

3. A mounting assembly as claimed in claim 1 wherein said last-named means is a sidewardly extending pin (74) carried by said tractor frame (12) and seating in enlarged apertures (68) in each bracket to substantially eliminate fore and aft loading on said pins (74) by said bracket to reduce the stresses on said tractor frame.

4. A mounting assembly for mounting a bulldozer blade (26) to a tractor frame (12), a C-frame (18) connected to said bulldozer blade and having arms (20,20) extending rearward therefrom, a pair of interconnected mounting brackets (30,30, 130,130), one portion (35,37, 135,137) of each bracket (30,130) being pinned (50,150) to said tractor frame, a trunnion (52,152) carried by a lower portion of each bracket, means (55,155) for pivotally connecting the arms (20,20) of said C-frame (18) to said trunnions (52,152), a sidewardly extending pin (74) carried by said tractor frame (12) seating in enlarged apertures (68) in each bracket to substantially eliminate fore and aft loading on said pins (74) thereby reducing the stresses on said tractor frame, and a belly guard (32) extending between said brackets (30,30) and capable of being pivoted down out of position about said sidewardly extending pins (74).

5. A mounting assembly for mounting a bulldozer blade (26) to a tractor frame (12), a C-frame (18) connected to said bulldozer blade and having arms (20,20) extending rearward therefrom, a pair of interconnected mounting brackets (30,30, 130,130), a pin (50,150) for pinning upwardly extending portions (35,37, 135,137) of each bracket (30,130) to said tractor frame, each said pin (50,150) passing through said upwardly extending portions (35,37, 135,137) of each bracket which upwardly extending portions span a side rail (23,123) of the tractor frame, a trunnion (52,152) carried by a lower portion of each bracket, means (55,155) for pivotally connecting the arms (20,20) of said C-frame (18) to said trunnions (52,152), and means (74,186) for supporting a remote portion (60,162) of each bracket on said tractor frame to permit fore and aft movement of said bracket relative to said tractor frame without applying shear forces therebetween.

6. A mounting assembly as claimed in claim 5 wherein said trunnion (52,152) on each bracket (30,130) hangs below said tractor frame when each said bracket (30,130) is pinned to said tractor frame.

7. In a mounting assembly for an inside arm bulldozer blade, a tractor frame (12), a bulldozer blade (26), a C-frame (18) connected to said bulldozer blade (26) and having arms (20,20) of the C-frame extending rearward therefrom, in combination, a pair of mounting brackets (30,30 130,130) joined together below said tractor frame by a belly guard (32,132), an upper end portion (35,37 135,137) of each bracket (30,30, 130,130) being attached by pins (50,150) to said tractor frame, a trunnion (52,152) extending outwardly from a lower portion of each bracket (30,130), means (55,155) for pivotally connecting the arms (20,20) of said C-frame (18) to said trunnions (52,152), each said bracket (30,30, 130 130) having a forward portion (60,162) spaced from said upper end portion (35,37, 135,137), an aperture (68,180) in said forward portion of each bracket, and means (74,186) passing through said aperture (68,180) in each forward portion of each bracket and being secured to said tractor frame, each said means (74,186) being spaced from the walls of said aperture so as to permit said bracket to move fore and aft relative to said tractor frame.

8. In a mounting assembly as claimed in claim 7 wherein said last-named means (186) includes at least one bolt (186) passing through a retainer (184) and spacer (182) both of which are spaced from said forward end portion (160) of each bracket and from the walls of the aperture (180) in said bracket to substantially eliminate fore and aft loading of said bolt (186) thereby reducing the stresses on said tractor frame.

9. In a mounting assembly as claimed in claim 7 wherein said last-named means (74) is a sidewardly extending pin (74) carried by said tractor frame (12) and seating in enlarged apertures (68) in each bracket (30), the space between said pins (74) and the walls of the enlarged apertures (68) permit fore and aft movement of said brackets (30) without loading said pins (74) thereby reducing the stresses on said tractor frame.

* * * * *